US012134045B1

(12) United States Patent
Harris et al.

(10) Patent No.: US 12,134,045 B1
(45) Date of Patent: Nov. 5, 2024

(54) ADJUSTABLE TOY FIGURE

(71) Applicant: Mattel, Inc., El Segundo, CA (US)

(72) Inventors: Daniel B. Harris, El Segundo, CA (US); Chandra A. Hicks, Hawthorne, CA (US); Steven P. Johnson, Long Beach, CA (US)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 18/311,750

(22) Filed: May 3, 2023

(51) Int. Cl.
*A63H 3/12* (2006.01)
*A63H 33/00* (2006.01)

(52) U.S. Cl.
CPC ..... *A63H 33/003* (2013.01); *A63H 3/12* (2013.01)

(58) Field of Classification Search
CPC ..... A63H 3/12; A63H 3/365; A63H 33/003
See application file for complete search history.

(56) References Cited

U.S. PATENT DOCUMENTS

| | | | | |
|---|---|---|---|---|
| 1,148,540 A | | 8/1915 | Sancier | |
| 1,416,624 A | | 5/1922 | Michael | |
| 1,468,281 A | | 9/1923 | Conover | |
| 1,615,924 A | | 2/1927 | Yancey | |
| 1,615,925 A | * | 2/1927 | Yancey | A63F 9/0413 D21/589 |
| 1,762,374 A | | 6/1930 | Yancey | |
| 1,766,008 A | | 6/1930 | Wilcox | |
| 1,966,986 A | | 7/1934 | Martin | |
| 2,195,127 A | | 3/1940 | Brucker | |
| 2,325,750 A | | 8/1943 | De Vries | |
| 2,584,798 A | | 2/1952 | Goerditz | |
| 3,811,220 A | | 5/1974 | Glass et al. | |
| 3,851,419 A | | 12/1974 | Kaelin | |
| 3,866,815 A | | 2/1975 | Desmond | |
| 3,961,439 A | | 6/1976 | Moustakas | |
| 4,107,873 A | | 8/1978 | Bauer | |
| 4,136,483 A | | 1/1979 | Shackelford et al. | |
| 4,411,097 A | | 10/1983 | Murakami | |
| 4,516,948 A | * | 5/1985 | Obara | A63H 33/003 446/376 |
| 4,568,304 A | | 2/1986 | Santa Maria | |
| 4,575,348 A | * | 3/1986 | Wiggs | A63H 13/16 446/330 |
| 4,639,233 A | | 1/1987 | Brassfield | |
| 4,695,264 A | | 9/1987 | McLeod | |
| 4,734,075 A | | 3/1988 | Park | |

(Continued)

FOREIGN PATENT DOCUMENTS

FR 2559072 A1 8/1985

OTHER PUBLICATIONS

"Fisher-Price My First Thomas the Tran, Flip and Switch Thomas and Percy", Lamsari, Jul. 16, 2017, 1 page, https://lamsari.com/model-raildroad-trains/973-fisher-price-my-first-thomas-the-train-flip-and-switch-thomas-and-percy.html.

*Primary Examiner* — John A Ricci
(74) *Attorney, Agent, or Firm* — Edell, Shapiro & Finnan, LLC

(57) ABSTRACT

A toy figure is presented herein. The toy figure includes a base, a body extending from the base, and a plurality of segments. At least some of the plurality of segments are configured to rotate relative to the base to transition the toy figure between a first configuration and a second configuration. The plurality of segments and the base cooperatively enclose the body in the first configuration, and the body is exposed in the second configuration.

20 Claims, 12 Drawing Sheets

(56) References Cited

U.S. PATENT DOCUMENTS

| | | | | |
|---|---|---|---|---|
| 4,781,648 | A | 11/1988 | Garfinkel | |
| 4,820,234 | A | 4/1989 | Isaf | |
| D307,307 | S | 4/1990 | Staake | |
| 4,921,459 | A | 5/1990 | Cook et al. | |
| D320,243 | S | 9/1991 | Mattson | |
| 5,090,938 | A | 2/1992 | Reynolds | |
| 5,149,289 | A | 9/1992 | Edwards et al. | |
| 5,417,606 | A | 5/1995 | Kimura | |
| 5,542,870 | A * | 8/1996 | Westersund | A63H 33/42 446/478 |
| 5,971,833 | A | 10/1999 | Rasmussen et al. | |
| 5,980,352 | A * | 11/1999 | Rigberg | B65D 81/368 446/73 |
| 6,261,146 | B1 | 7/2001 | Spector | |
| 6,572,436 | B1 | 6/2003 | So | |
| D553,696 | S | 10/2007 | Sato et al. | |
| D554,205 | S | 10/2007 | Sato et al. | |
| D558,281 | S | 12/2007 | Sato et al. | |
| 7,306,504 | B2 * | 12/2007 | Saucier | A63H 33/003 446/268 |
| D564,048 | S | 3/2008 | Sato et al. | |
| D585,503 | S | 1/2009 | Sato et al. | |
| D585,504 | S | 1/2009 | Sato et al. | |
| D590,453 | S | 4/2009 | Sato et al. | |
| D590,455 | S | 4/2009 | Sato et al. | |
| D591,802 | S | 5/2009 | Sato et al. | |
| D593,624 | S | 6/2009 | Sato et al. | |
| D594,916 | S | 6/2009 | Sato et al. | |
| 7,731,563 | B2 | 6/2010 | Saucier | |
| 7,785,168 | B2 * | 8/2010 | Yamada | A63H 3/003 446/99 |
| 8,348,715 | B2 | 1/2013 | Miyake | |
| 9,415,322 | B2 | 8/2016 | Kanauchi | |
| 9,675,899 | B2 | 6/2017 | Nishimoto et al. | |
| 10,252,175 | B2 * | 4/2019 | Moore | A63H 33/003 |
| 10,987,604 | B2 | 4/2021 | Yamada et al. | |
| 11,235,253 | B2 | 2/2022 | Towne et al. | |
| 11,376,515 | B1 | 7/2022 | Livingston et al. | |
| 2015/0306516 | A1 | 10/2015 | Stocker-Edwards | |

* cited by examiner

ADJUSTABLE TOY FIGURE

TECHNICAL FIELD

The present application relates generally to toy figures and, in particular, to a toy figure with features that are adjustable to change an appearance of the toy figure.

BACKGROUND

Toy figures provide entertainment for different users, such as children. For example, a toy figure may include adjustable features that may entertain a child. A user can move the adjustable features relative to one another. Movement of the adjustable features may change an appearance of the toy playset, such as to provide different presentations of a portrayed entity. Thus, the user can interact with the toy figure to change its appearance via the adjustable features, and the change in appearance can entertain the user. New adjustable features can provide added play value and, thus, are continuously desired.

SUMMARY

A toy figure is presented herein. According to one example embodiment, the toy figure includes a base, a body extending from the base, and a plurality of segments. A subset of the plurality of segments is configured to rotate relative to the base to transition the toy figure between a first configuration and a second configuration. The plurality of segments and the base cooperatively enclose the body in the first configuration, and the body is exposed in the second configuration.

Other systems, methods, features and advantages will be, or will become, apparent to one with skill in the art upon examination of the following figures and detailed description. All such additional systems, methods, features, and advantages are included within this description and are within the scope of the claimed subject matter.

BRIEF DESCRIPTION OF THE DRAWINGS

The toy figure presented herein may be better understood with reference to the following drawings and description. Unless dimensions of elements of the drawings are specifically called-out and described herein, it should be understood that the elements in the figures are not necessarily to scale and that emphasis has been placed upon illustrating the principles of the toy figure. In the figures, like-referenced numerals designate corresponding parts throughout the different views.

DETAILED DESCRIPTION

Overall, a toy figure is presented herein. The toy figure includes a base, a body extending from the base, and a plurality of segments. A subset of the plurality of segments is configured to rotate relative to the base to transition the toy figure between a first configuration and a second configuration. For example, the plurality of segments and the base cooperatively enclose the body in the first configuration, and the body is exposed in the second configuration. As such, the appearance of the toy figure changes (e.g., the body may be covered or visible) between the first configuration and the second configuration. Such a transition between the first configuration and the second configuration is a unique feature that may entertain a user.

Figure 1:
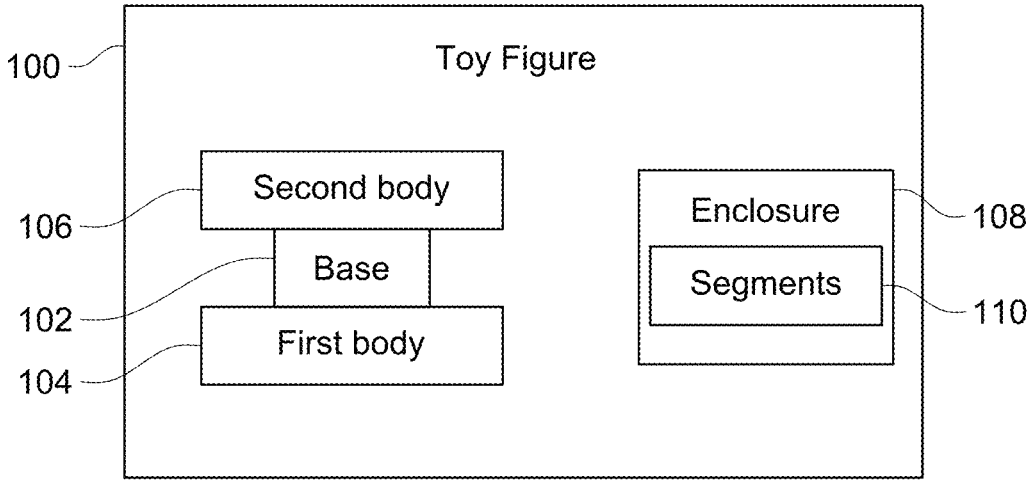
FIG. 1 illustrates a schematic diagram of a toy figure in accordance with an example embodiment of the present application.

FIG. 1 illustrates a schematic diagram of an embodiment of a toy FIG. 100. The toy FIG. 100 includes a base 102, a first body 104 extending from the base 102 (e.g., from a first side of the base 102), and a second body 106 extending from the base 102 (e.g., from a second side of the base 102). The toy FIG. 100 also includes an enclosure 108, which is composed of multiple segments 110. The segments 110 may be adjustable to adjust an arrangement of the enclosure 108. For example, a user may interact with the segments 110 to cause the enclosure 108 to selectively enclose the first body 104 or the second body 106.

By way of example, a first subset of the segments 110 may be adjustably coupled to the base 102, and a second subset of the segments 110 may be adjustably coupled to at least one of the first subset of the segments 110. The first subset of the segments 110 may move about the base 102 to extend toward the first body 104 or the second body 106. For instance, in a first configuration of the toy FIG. 100, the first subset of the segments 110 extends along the first body 104 and away from the second body 106 to surround the first body 104. The second subset of the segments 110 may be moved about the first subset of the segments 110 to cover the first body 104. As such, in the first configuration, the base 102 and the segments 110 cooperatively enclose the first body 104, while exposing the second body 106.

In a second configuration of the toy FIG. 100, the segments 110 may extend along the second body 106 and away from the first body 104 to surround and enclose the second body 106. The base 102 and the segments 110 may cooperatively enclose the second body 106, while exposing the first body 104, in the second configuration. In either configuration, the second subset of the segments 110 may be coupled to the first subset of the segments 110, e.g., to maintain enclosure of the first body 104 or the second body 106. The coupling may create tactile feedback that alerts the user that the coupling is complete, which may also provide a pleasing play feature.

In some embodiments, the first subset of the segments 110 may rotate about the base 102 to adjust the toy FIG. 100 between the first configuration and the second configuration. Further, the second subset of the segments 110 may rotate about at least one of the first subset of the segments 110 to adjust the toy FIG. 100 between the first configuration and the second configuration. In additional or alternative embodiments, the segments 110 may be moved in any other suitable manner to adjust the toy FIG. 100 between the first configuration and the second configuration.

Additionally, the segments 110 may be manually moveable by the user to enable the user to selectively adjust the toy FIG. 100 between the first configuration and the second configuration. Transition of the toy FIG. 100 between the first configuration and the second configuration may entertain the user. For example, the toy FIG. 100 may have a first appearance in the first configuration and a second appearance, different from the first appearance, in the second configuration, and the adjustability of the appearance of the toy FIG. 100 may entertain the user.

Figure 2:
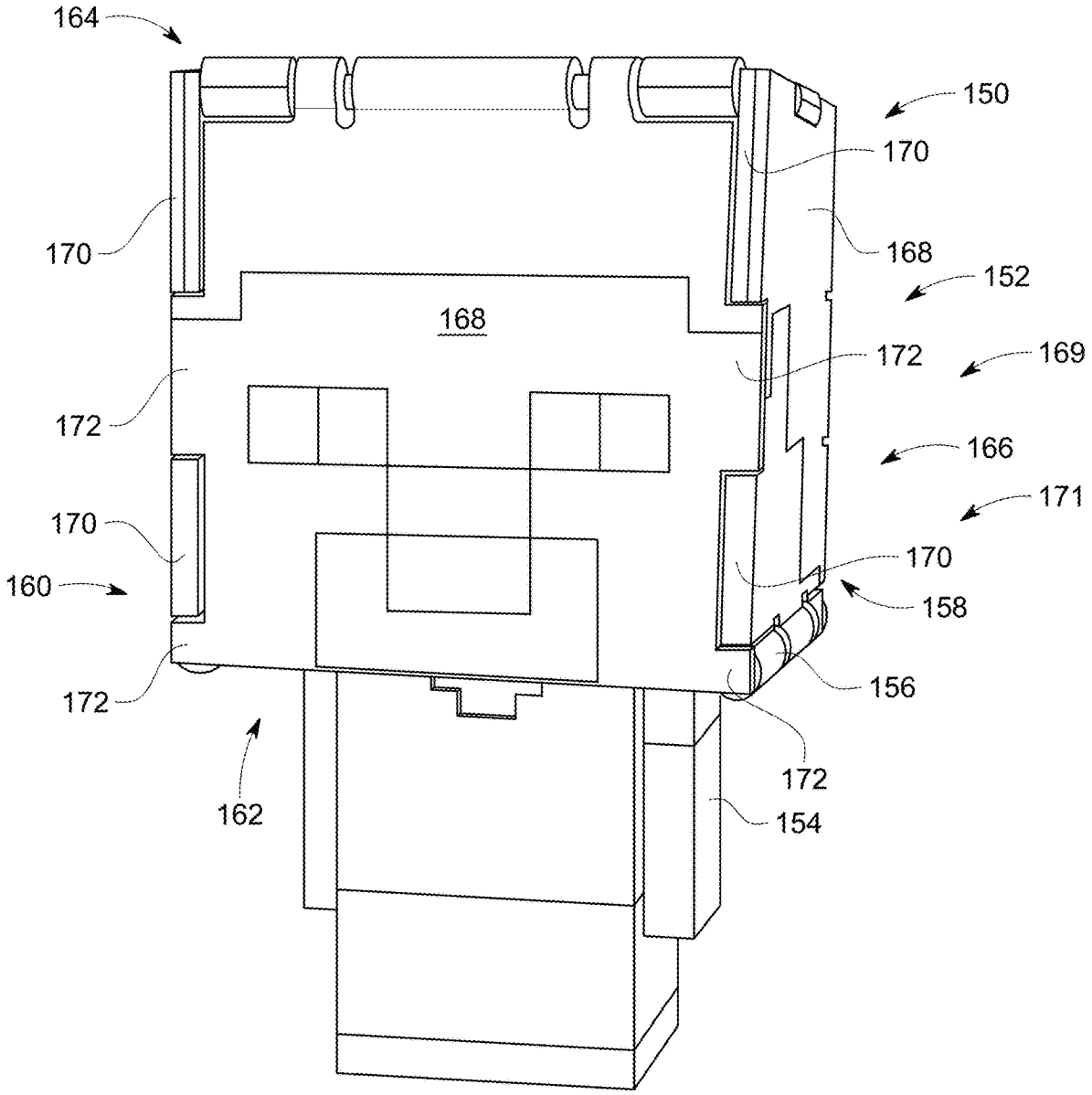
FIG. 2 illustrates a perspective view of a toy figure in a first configuration in accordance with an example embodiment of the present application.

FIG. 2 illustrates a perspective view of a toy FIG. 150 in a first configuration 152. In the first configuration 152, a first body 154 extending from a base 156 of the toy FIG. 150 is exposed. Meanwhile, a plurality of segments forms an enclosure 166 of the toy FIG. 150. More specifically, a first segment 158 (e.g., a first lateral segment), a second segment 160 (e.g., a second lateral segment) opposite the first segment 158 (e.g., extending parallel relative to the first segment 158), a third segment 162 (e.g., a front segment), a fourth segment 164 (e.g., a distal segment), and a fifth segment 250 (e.g., a rear segment visible in at least FIG. 4) opposite the third segment 162 form the enclosure 166 of the toy FIG. 150. In the first configuration 152, the first segment 158, the second segment 160, the third segment 162, and the fifth segment extend from the base 156 away from the first body 154. As such, the enclosure 166 does not surround the first body 154 in the first configuration 152.

In the depicted embodiment, the third segment 162 is positioned between the first segment 158 and the second segment 160 (e.g., extending crosswise to the first segment 158 and to the second segment 160). The fifth segment 250 is also positioned between the first segment 158 and the second segment 160 (e.g., extending crosswise to the first segment 158 and to the second segment 160, extending parallel to the third segment 162). Meanwhile, the fourth segment 164 extends between the first segment 158 and the second segment 160 (e.g., extending crosswise to the first segment 158, the second segment 160, the third segment 162, and the fifth segment 250). For example, the fourth segment 164 sits atop the first segment 158, the second segment 160, the third segment 162, and the fifth segment 250. Thus, in the depicted embodiment, the enclosure 166 is a substantially cuboid enclosure. This may resemble unique play characters, such as MINECRAFT characters.

The arrangement of the segments 158, 160, 162, 164 in the first configuration 152 form an internal volume 200 (see FIG. 3) or chamber within the enclosure 166. First surfaces 168 of the enclosure 166 face away from the internal volume 200 in the first configuration 152 and may therefore be considered external surfaces in the first configuration 152, whereas second surfaces 350 (see FIGS. 7-9) face the internal volume 200 in the first configuration 152 and may therefore be considered internal surfaces in the first configuration 152. For example, the first surface 168 of the third segment 162 faces away from the internal volume and is therefore exposed and visible. The first segment 158, the second segment 160, the fourth segment 164, and/or the fifth segment also have corresponding first surfaces 168 that are exposed and visible in the first configuration 152. In the first configuration 152, these first surfaces 168 collectively define a first head portion 169 with a first appearance 171.

The segments 158, 160, 162, 164 may couple to one another to retain the toy FIG. 150 in the first configuration 152. As an example, each of the first segment 158 and the second segment 160 includes first extensions 170 that are offset from one another to form a space, gap, or channel extending therebetween. The third segment 162 includes second extensions 172 that are also offset from one another to form a space, gap, or channel extending therebetween. The first extensions 170 and the second extensions 172 may interface with one another in the first configuration 152 to couple the segments 158, 160, 162 to one another.

More specifically, in the depicted embodiment, one of the second extensions 172 of the third segment 162 extends into the space between the first extensions 170 of the first segment 158 such that the first extensions 170 of the first segment 158 capture the second extension 172 (e.g., via an interference fit). One of the first extensions 170 of the first segment 158 also extends into the space formed between two of the second extensions 172 of the third segment 162 such that the second extensions 172 capture the first extensions 170 of the first segment 158 (e.g., via an interference fit), thereby coupling the first segment 158 and the third segment 162 to one another. Another one of the second extensions 172 of the third segment 162 extends into the space between the first extensions 170 of the second segment 160 such that the first extensions 170 of the second segment 160 capture the second extensions 172 (e.g., via an interference fit). One of the first extensions 170 of the second segment 160 also extends into the space formed between two of the second extensions 172 of the third segment 162 such that the second extensions 172 capture the first extensions 170 of the second segment 160 (e.g., via an interference fit), thereby coupling the second segment 160 and the third segment 162 to one another. The first segment 158 and/or the second segment 160 may also similarly couple to the fourth segment 164 and/or to the fifth segment 250 to maintain the arrangement of the enclosure 166 in the first configuration 152.

The illustrated first appearance 171 provided by the first head portion 169 is of a first human person. For example, the enclosure 166 includes imagery that provides an appearance of a head (e.g., the first surface 168 of the third segment 162 includes imagery that portrays facial features and/or hair, while the remaining first surfaces 168 depict corresponding features, such as ears, hair, etc.) of the first human person and/or character, and the first body 154 includes imagery that provides an appearance of a remainder (e.g., torso, arms, legs) of the first human person and/or character. However, the toy FIG. 150 may have a different appearance (e.g., to provide an appearance of an animal or inanimate object) in additional or alternative embodiments. Moreover, although the illustrated toy FIG. 150 has a generally rectangular shape, including a cubic enclosure 166, the toy FIG. 150 may have any suitable shape in additional or alternative embodiments. For example, the toy FIG. 150 may have a different prismatic shape, a circular or curved shape, or an irregular shape, and/or the enclosure 166 may form a different shape (e.g., a pyramidal shape, a dodecahedral shape, a different cuboid shape) in additional or alternative embodiments.

Figure 3:
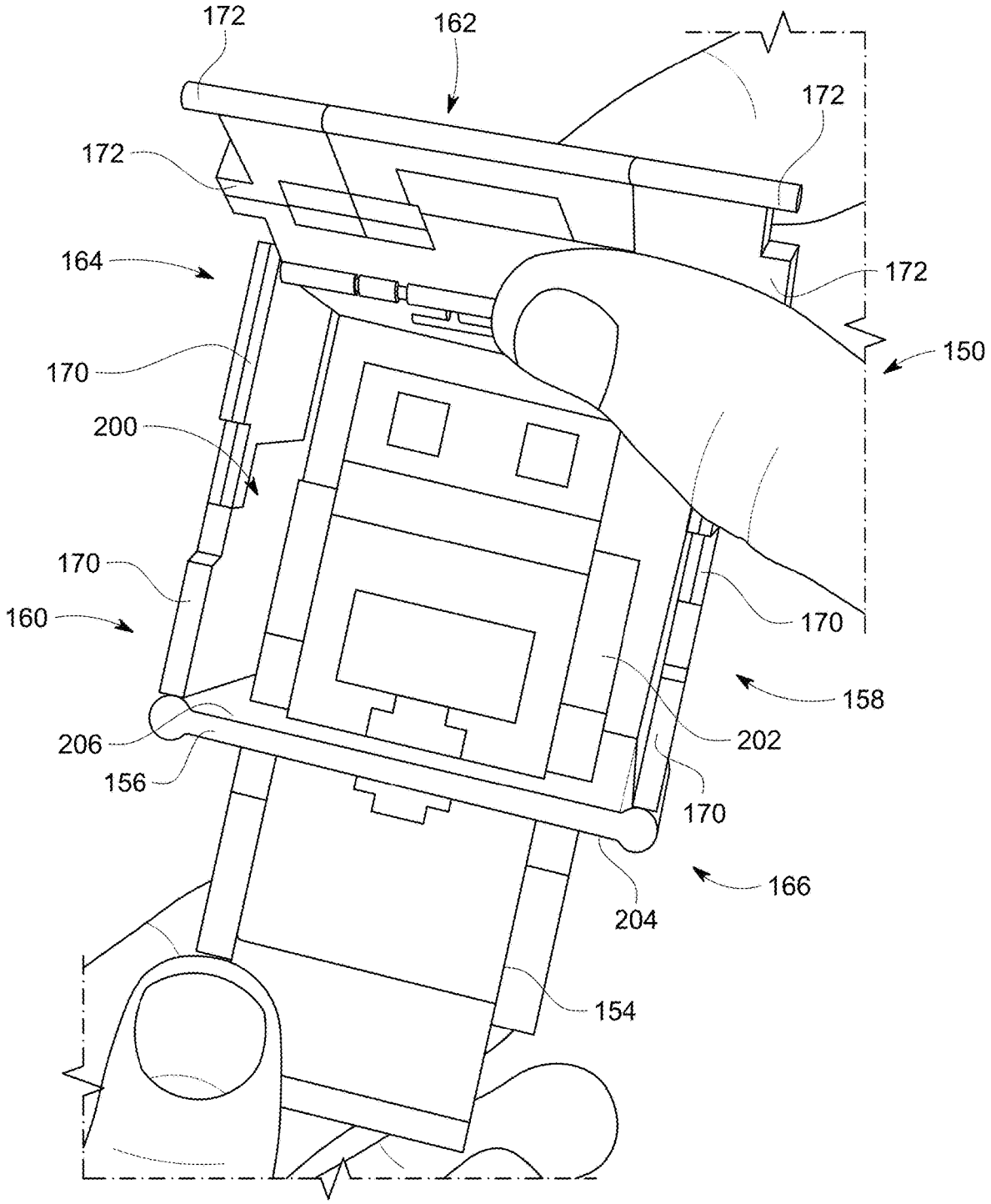
FIGS. 3-8 illustrate perspective views of the toy figure of FIG. 2 in transition from the first configuration to a second configuration.
Figure 9:
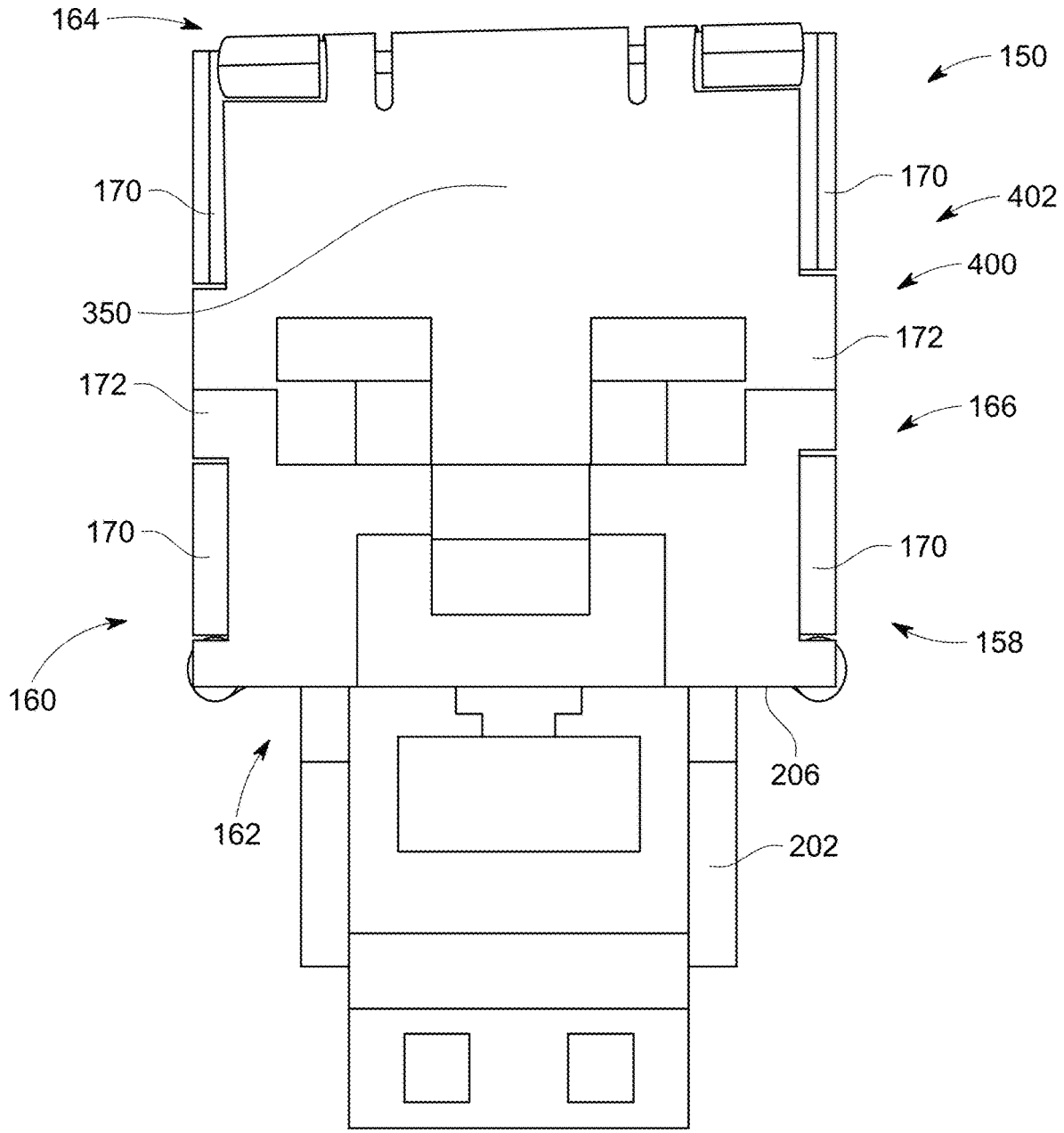
FIG. 9 illustrates a perspective view of the toy figure of FIG. 2 in the second configuration.

FIG. 3 illustrates a perspective view of the toy FIG. 150 transitioning from the first configuration 152 toward a second configuration 400 (see FIG. 9). In this example, the third segment 162 may be rotated (e.g., via a manually applied force) about the fourth segment 164 to decouple from the first segment 158 and from the second segment 160. Thus, the first extensions 170 of the first segment 158 no longer interface with the second extensions 172 of the third segment 162, and the first extensions 170 of the second segment 160 no longer interface with the second extensions 172 of the third segment 162. The third segment 162 may not be attached to the base 156 to enable the third segment 162 to rotate about the fourth segment 164 and move away from the base 156.

Such movement of the third segment 162 also exposes an internal volume 200 formed by the enclosure 166. In the illustrated embodiment, the toy FIG. 150 includes a second body 202 extending from the base 156. By way of example, the first body 154 extends from a first side 204 (e.g., a first surface) of the base 156, and the second body 202 extends from a second side 206 (e.g., a second surface), opposite the first side 204, of the base 156. Thus, the first body 154 and the second body 202 extend in opposite directions. To form the internal volume 200 at the second side 206 in the first configuration 152, the first segment 158, the second segment 160, the third segment 162, and the fifth segment extend outwardly from the second side 206, away from the first side 204. Thus, the second side 206 faces the internal volume 200 in the first configuration 152 and the second body 202, which extends from the second side 206, is positioned within the internal volume 200 in the first configuration 152. Additionally, first side 204 faces away from the internal volume 200 in the first configuration 152 such that the first side 204 is visible exteriorly of enclosure 166. The first body 154, which extends from the first side 204, is also external to the enclosure 166.

Figure 4:
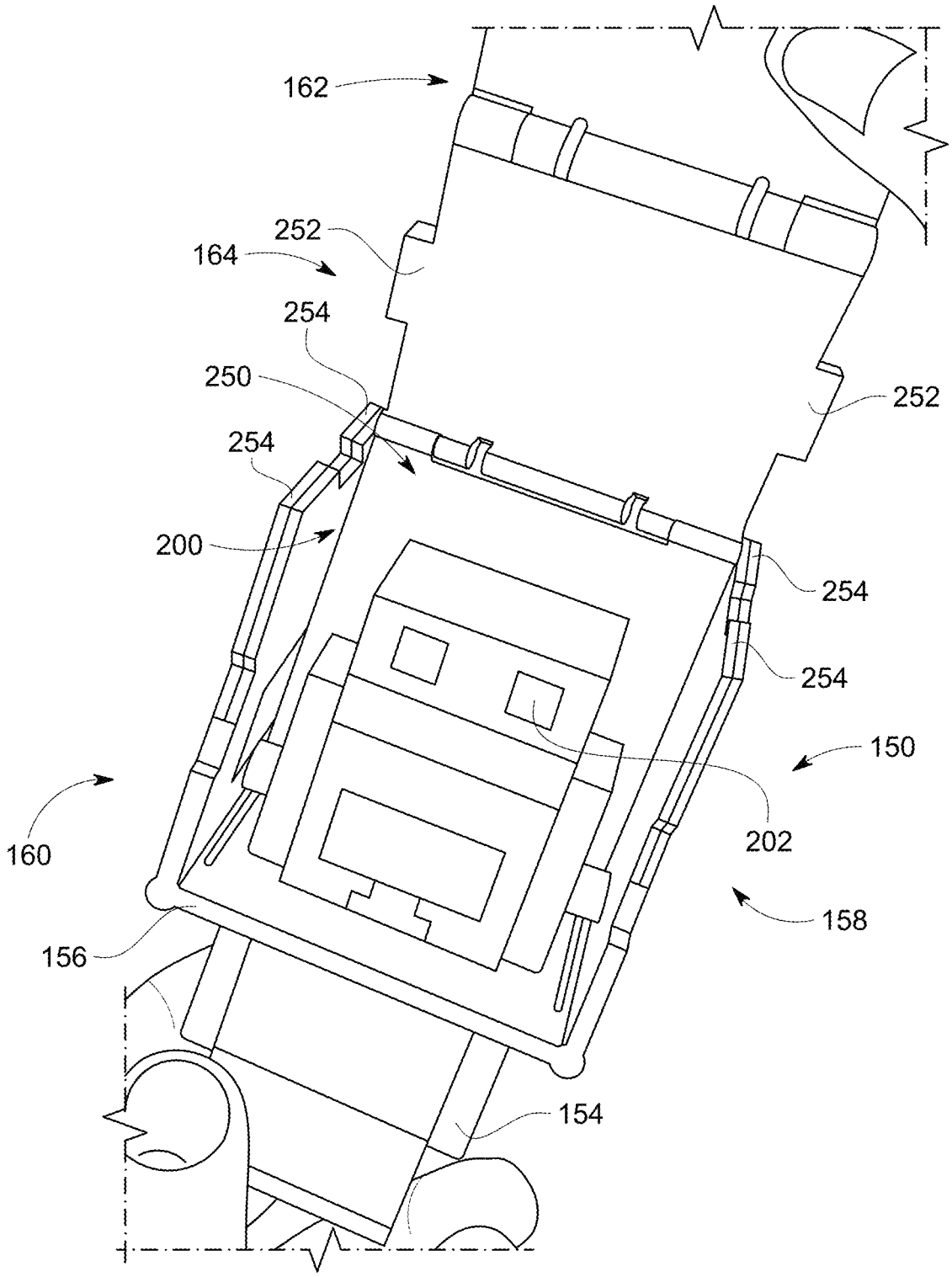

FIG. 4 illustrates a perspective view of the toy FIG. 150 further transitioning toward the second configuration 400. In the depicted embodiment, the fourth segment 164 is rotatably coupled to the fifth segment 250, which extends from the first segment 158 to the second segment 160. Thus, the fourth segment 164 may be rotated (e.g., via a manually applied force) about the fifth segment 250 and away from the base 156 to decouple from the first segment 158 and from the second segment 160. As an example, third extensions 252 of the fourth segment 164 may be disengaged from fourth extensions 254 of the first segment 158 and/or of the second segment 160 as a result of rotation of the fourth segment 164 away from the second body 202. Prior to this disengagement, the third extensions 252 of the fourth segment 164 may interface with the fourth extensions 254 of the first segment 158 and/or of the second segment 160 (e.g., the third extensions 252 may have been previously inserted within respective spaces formed between the fourth extensions 254 such that the fourth extensions 254 captured the third extensions 252 in the first configuration 152). Consequently, disengaging the third extensions 252 and rotating the fourth segment 164 may further expose the internal volume 200 and the second body 202.

Figure 5:
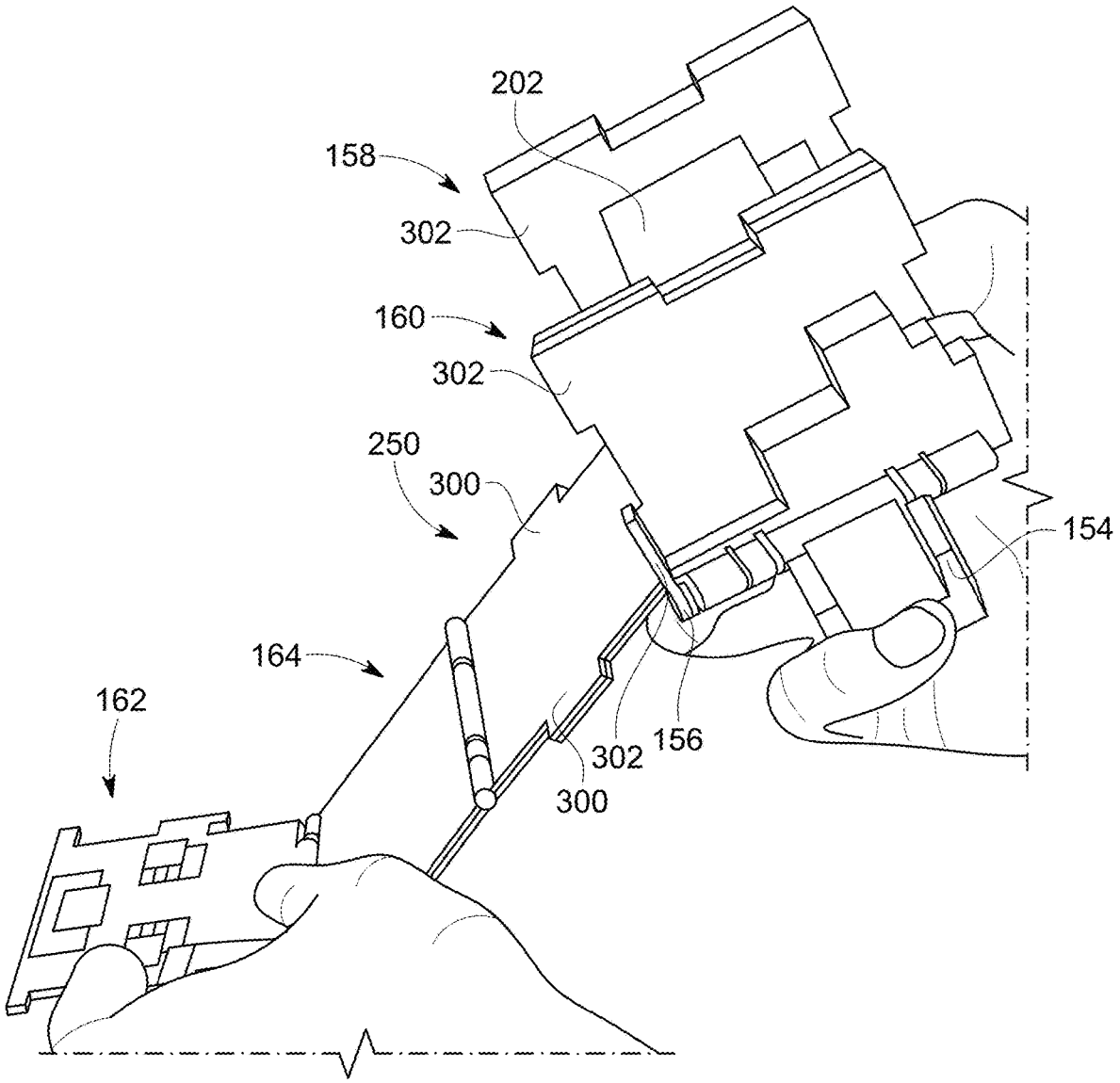

FIG. 5 illustrates a perspective view of the toy FIG. 150 further transitioning toward the second configuration 400. In this embodiment, the fifth segment 250 is rotatably coupled to the base 156. Thus, the fifth segment 250 may be rotated (e.g., via a manually applied force) about the base 156, away from the second body 202, and toward the first body 154. During such rotation, the fifth segment 250 is decoupled from the first segment 158 and from the second segment 160. For instance, fifth extensions 300 of the fifth segment 250 may be disengaged from sixth extensions 302 of the first segment 158 and/or of the second segment 160 as a result of rotation of the fifth segment 250 away from the second body 202. Prior to this disengagement, the fifth extensions 300 may interface with the sixth extensions 302 of the first segment 158 and/or of the second segment 160. That is, in the first configuration 152, the fifth extensions 300 may have been previously inserted within respective spaces formed between the sixth extensions 302 such that the sixth extensions 302 captured the fifth extensions 300 in the first configuration 152.

Figure 6:
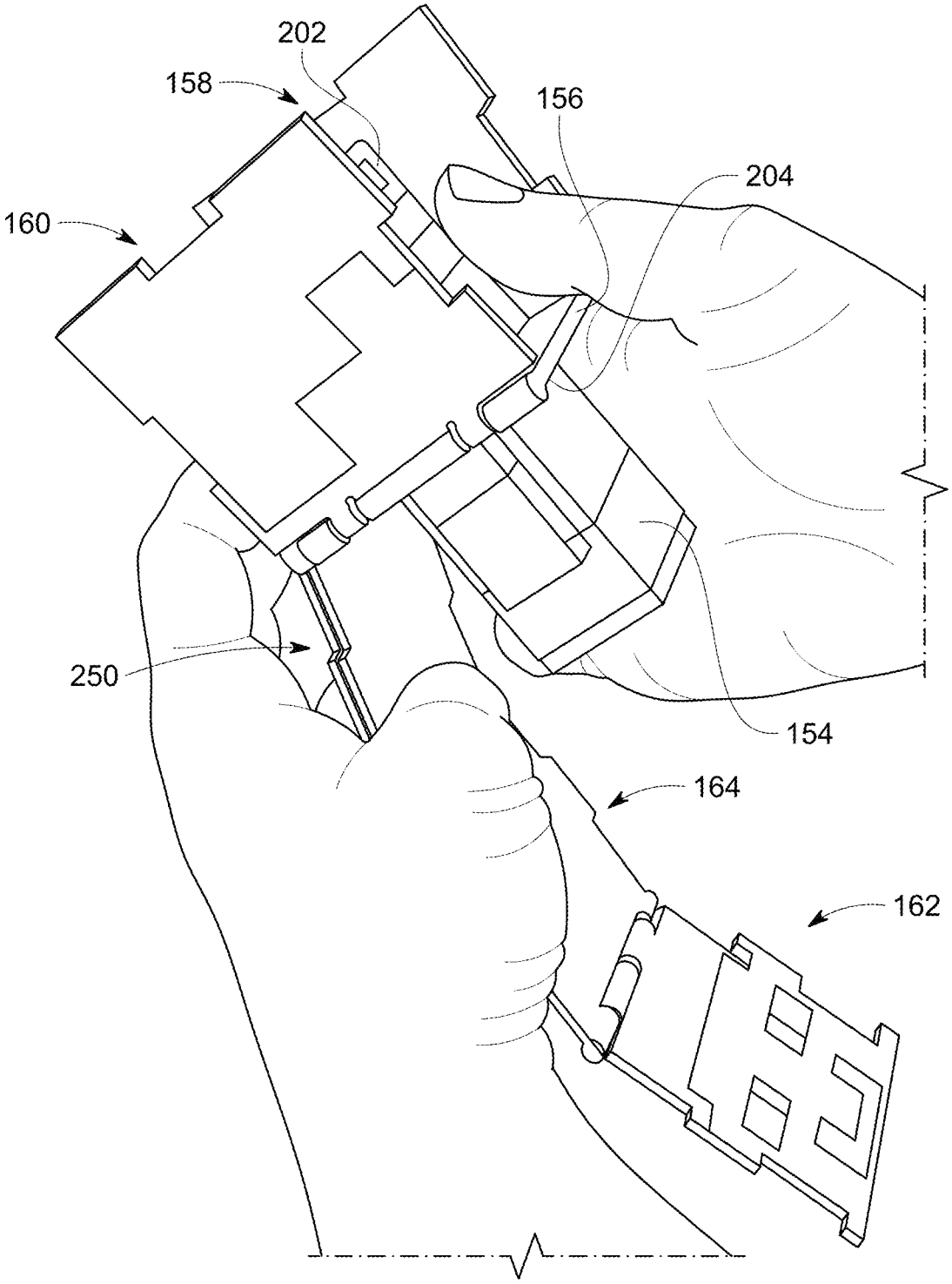

FIG. 6 illustrates a perspective view of the toy FIG. 150 further transitioning toward the second configuration 400. In particular, the fifth segment 250 is now further rotated (e.g., via a manually applied force) about the base 156, away from the second body 202, and toward the first body 154 such that the fifth segment 250 extends generally along the first body 154. In this manner, the fifth segment 250 extends at least partially in a direction in which the first side 204 faces.

Figure 7:
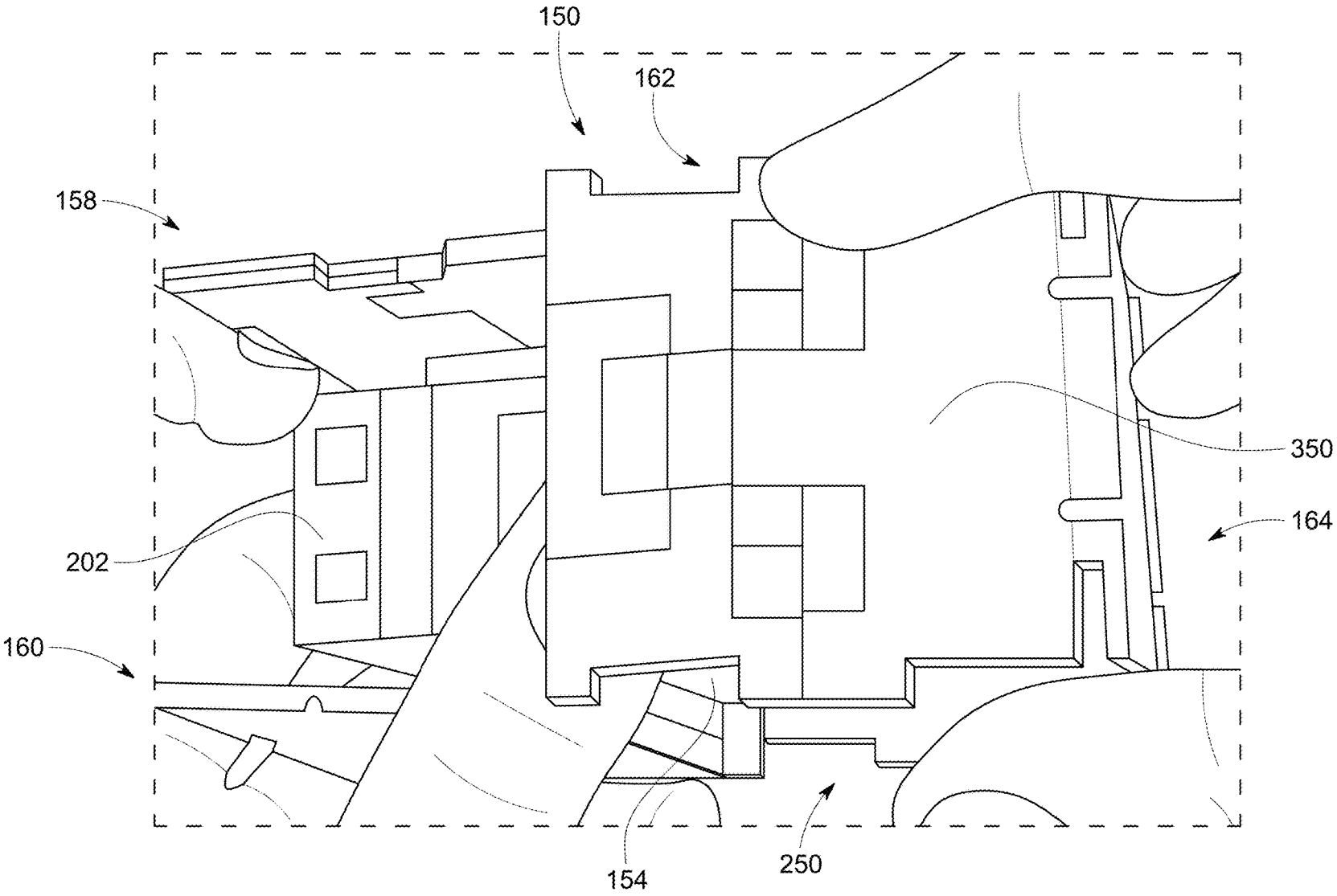

FIG. 7 illustrates a perspective view of the toy FIG. 150 further transitioning toward the second configuration. In the illustrated embodiment, the third segment 162, the fourth segment 164, and the fifth segment 250 cooperatively surround the first body 154 at this stage of a configuration transition, thereby partially enclosing the first body 154. For example, the fourth segment 164 may be rotated about the fifth segment 250 (e.g., via a manually applied force) and the third segment 162 may be rotated about the fourth segment 164 (e.g., via a manually applied force) such that the third segment 162, the fourth segment 164, and the fifth segment 250 cooperatively form a U-shaped configuration about the first body 154. In such a configuration, a second surface 350, opposite the first surface 168, of the third segment 162 is exposed. That is, to transition the toy FIG. 100 to the second configuration, the second surface 350 of the third segment 162 is oriented to face away from the first body 154 (e.g., outwards) and the first surface 168 is oriented to face the first body 154 (e.g., inwards). By comparison, in the first configuration 152, the first surface 168 of the third segment 162 faces away from the second body 202 (e.g., outwards) and the second surface 350 of the third segment 162 faces the second body 202 (e.g., inwards).

Figure 8:
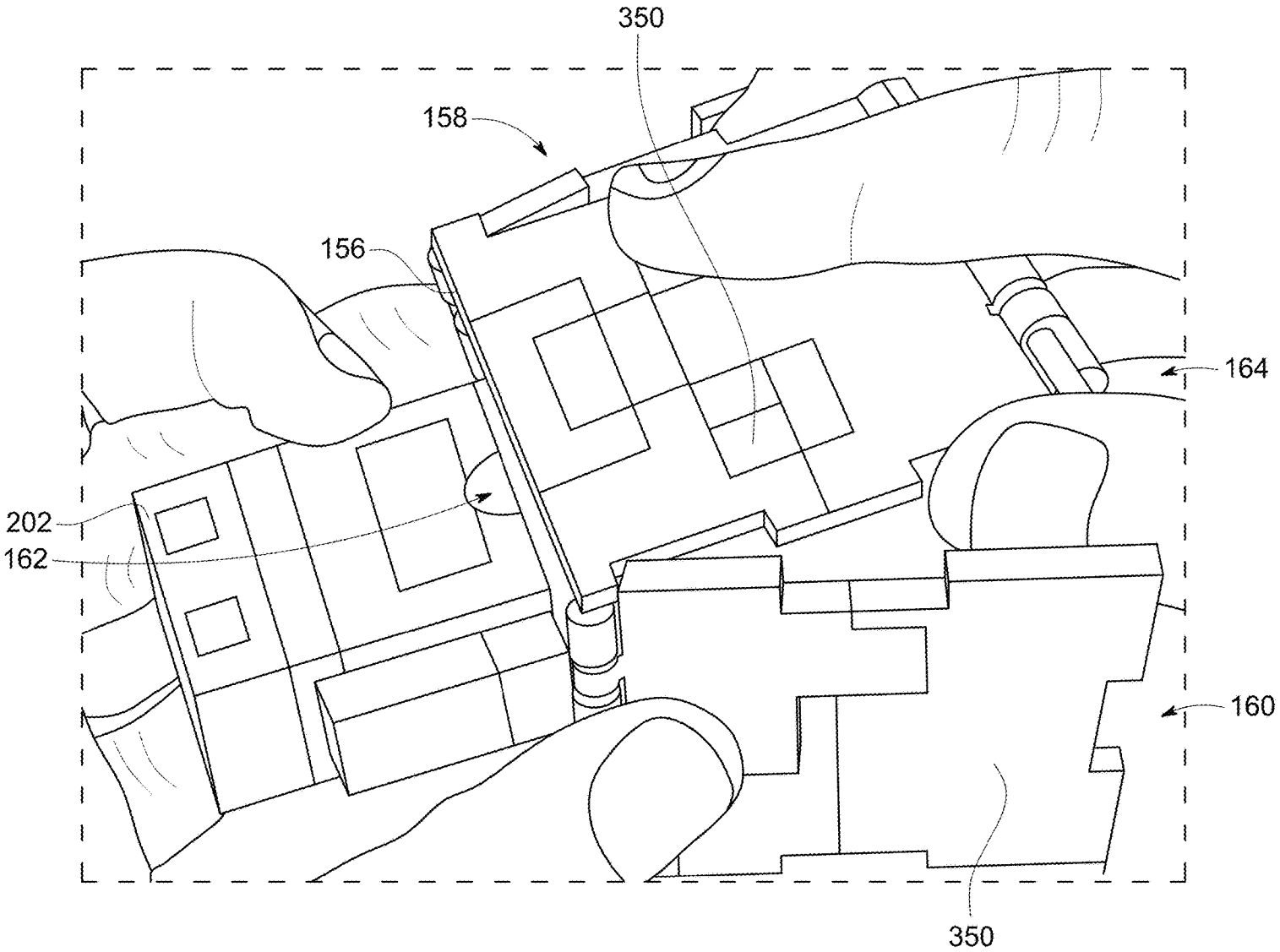

FIG. 8 illustrates a perspective view of the toy FIG. 150 further transitioning toward the second configuration. Specifically, FIG. 8 shows the first segment 158 and the second segment 160 rotating about the base 156, away from the second body 202, and toward the first body 154. For example, the first segment 158 and the second segment 160 are rotated toward the third segment 162, the fourth segment 164, and the fifth segment 250 that surround the first body 154. As a result, the first body 154 is further covered by the segments 158, 160, 162, 164, 250.

FIG. 9 illustrates a perspective view of the toy FIG. 150 in the second configuration 400. In the second configuration 400, each of the first segment 158 and the second segment 160 is coupled to the third segment 162, the fourth segment 164, and the fifth segment 250. As an example, the second extensions 172 of the third segment 162 interface with (e.g., capture, are captured by) the first extensions 170 of the first segment 158 and/or of the second segment 160. The first segment 158 and/or the second segment 160 may similarly couple to the fourth segment 164 and/or to the fifth segment 250. As such, the segments 158, 160, 162, 164, 250 are coupled to one another to re-form the enclosure 166 (or, from another perspective, to form a new enclosure) and maintain the arrangement of the enclosure 166 in the second configuration 400. In this manner, each of the first segment 158 and the second segment 160 is coupled to the third segment 162, the fourth segment 164, and the fifth segment 250 in each of the first configuration 152 and the second configuration 400.

In the second configuration 400, the base 156 and the segments 158, 160, 162, 164, 250 cooperatively enclose the first body 154 and expose the second body 202. That is, in the second configuration 400, the first segment 158, the second segment 160, the third segment 162, and the fifth segment 250 extend away from the first side 204 of the base 156 to form the internal volume 200. Thus, the first side 204 faces the internal volume 200 in the second configuration 400 and the first body 154, which extends from the first side 204, is positioned within the internal volume 200. Additionally, the second side 206 of the base 156 faces away from the internal volume 200 of the enclosure 166 in the second configuration 400, and the second body 202 is external to the enclosure 166. Still further, the first surfaces 168 of the enclosure 166, including the first surface 168 of the third segment 162, face the internal volume 200 of the enclosure 166 and may therefore be considered internal surfaces in the second configuration 400. The second surfaces 350 of the enclosure 166, including the second surface 350 of the third segment 162, face away from the internal volume 200 in the second configuration 400 and may therefore be considered external surfaces in the second configuration 400.

In some embodiments, the second body 202 may be similarly shaped as compared to the first body 154. For example, each of the bodies 154, 202 may have a rectangularly prismatic shape. Alternatively, the bodies 154, 202 may be differently shaped and/or sized. In any case, the bodies 154, 202 are of a sufficiently small size to enable the enclosure 166 to fully enclose each of the bodies 154, 202 (e.g., the bodies 154, 202 do not extend beyond the internal volume 200 in the first configuration 152 or the second configuration 400, respectively).

The appearance of the toy FIG. 150 in the second configuration 400 may be different from the appearance of the toy FIG. 150 in the first configuration 152. For instance, the enclosure 166 (e.g., at least the second surface 350 of the third segment 162) may include different imagery that is visible in the second configuration 400 to portray a second appearance 402 of a second human person and/or character, different from the first appearance 171 of first human person and/or character portrayed in the first configuration 152. Additionally or alternatively, the second body 202 may have a different appearance than that of the first body 154. For example, the first body 154 may have an appearance that matches or coordinates with an appearance of the first surfaces 168 of the enclosure 166 in the first configuration 152, while the second body 202 may have an appearance that matches or coordinates with an appearance of the second surfaces 350 of the enclosure 166 in the second configuration 400. As such, adjustment of the segments 158, 160, 162, 164, 250 (e.g., to change enclosure of the bodies 154, 202) may completely or entirely alter the appearance of the toy FIG. 150 (i.e., as opposed to only changing a face or other such portion to partially change the appearance). The change in appearance of the toy FIG. 150 may entertain a user. By way of example, the user can interact with the toy FIG. 150 to selectively adjust the appearance of the toy FIG. 150 via the segments 158, 160, 162, 164, 250.

Although the toy FIG. 150 depicted in the Figures includes three segments (e.g., the first segment 158, the second segment 160, and the fifth segment 250) that are coupled to and configured to rotate about the base 156, a toy figure may include any suitable number of segments that are coupled to and configured to rotate about a base to transition between different configurations. As an example, a toy figure may include a single segment coupled to and configured to rotate about a base, and the toy figure may include multiple other segments that are coupled to and configured to rotate about the segment coupled to the base. The segments may be rotated relative to one another and the base to transition between the different configurations. As another example, all segments of a toy figure may be coupled to and configured to rotate about a base. For instance, the segments may rotate about the base to couple to one another to form an enclosure. In additional or alternative embodiments, any of the segments may be configured to couple to and decouple from the base and/or each other. For example, the segments may be coupled to the base to secure the arrangement of the enclosure, and the segments may be easily decoupled from the base to enable adjustment of the enclosure and changing of the configuration of the toy figure. Indeed, any of the segments may be separated from a remainder of the toy figure in some embodiments. Still further, the segments need not rigid, and at least a portion of at least some of the segments might be flexible and/or include flexible features.

Figure 10A:
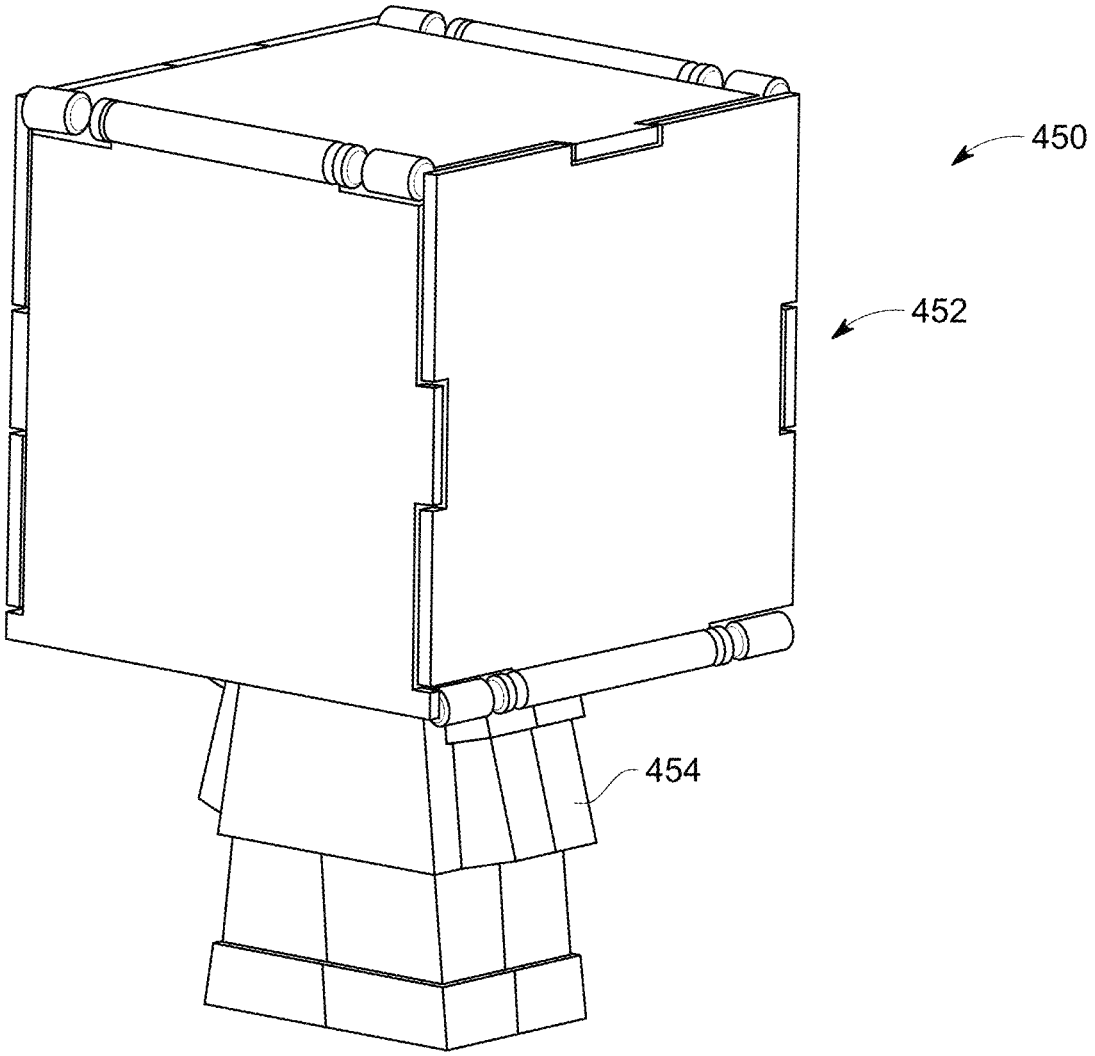
FIGS. 10A-10C illustrate perspective views of toy figures in accordance with additional example embodiments of the present application.
Figure 10B:
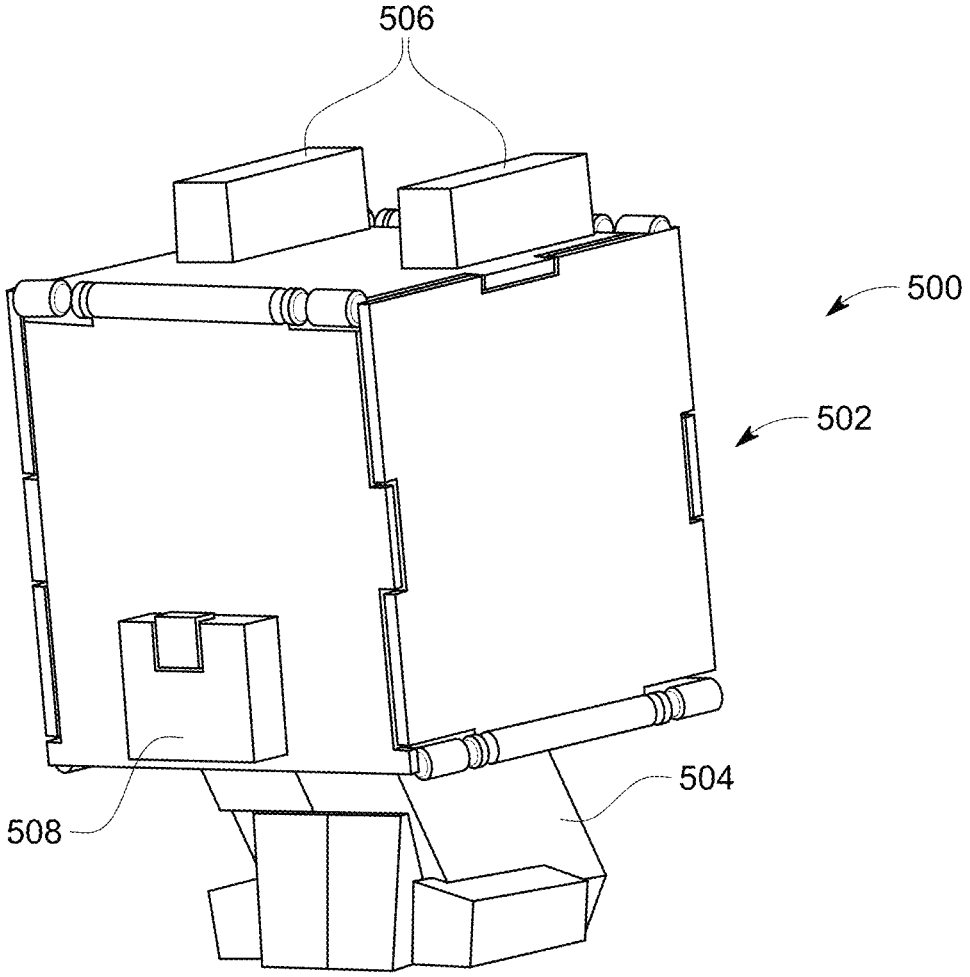
Figure 10C:
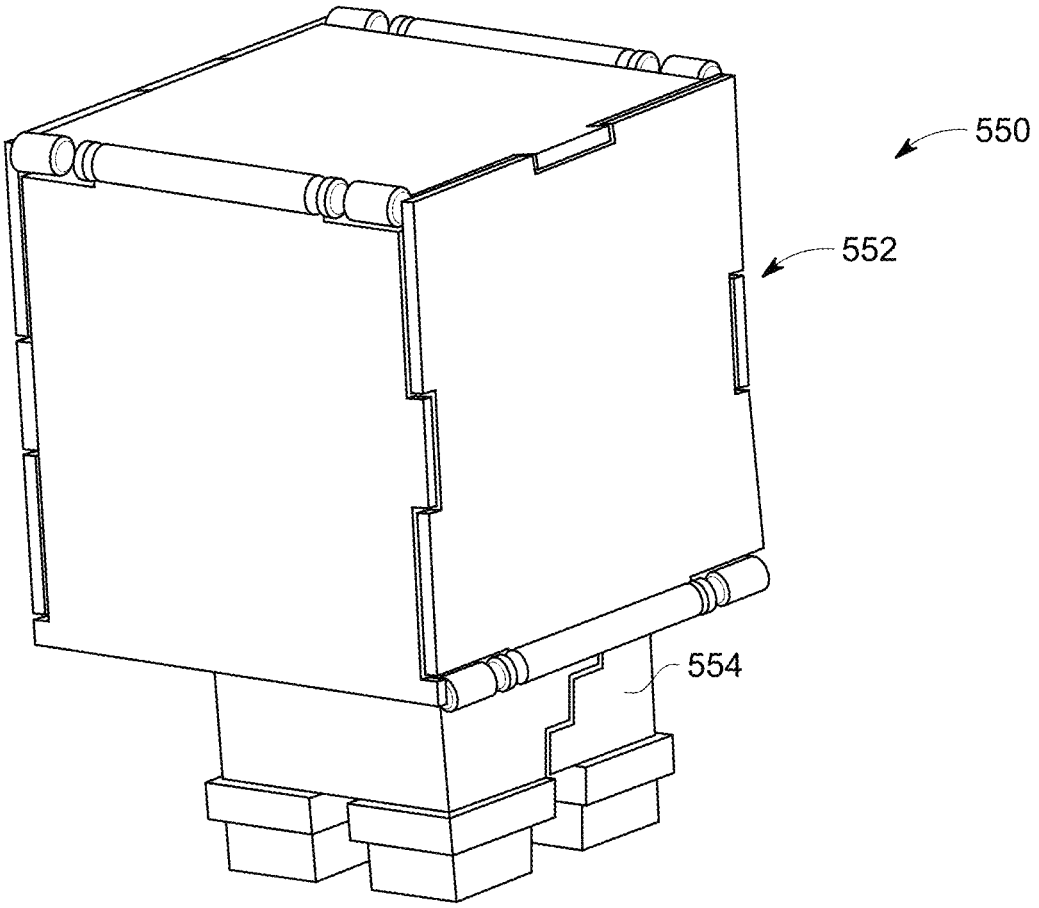

Each of FIGS. 10A-10C illustrates a perspective view of a different embodiment of a toy figure. Each of the toy figures illustrated in FIGS. 10A-10C may have similar features as that of the toy FIG. 150, such as segments that are adjustable between different configurations, but the toy figures may provide appearances of different entities.

FIG. 10A illustrates a perspective view of a toy FIG. 450, which includes an enclosure 452 with adjustable segments. The toy FIG. 450 also includes a body 454 that is exposed in the illustrated embodiment. The body 454 may provide an appearance of another human person and/or character. However, the body 454 may be differently shaped as compared to the bodies 154, 202 of the toy FIG. 150. By way of example, the body 454 may have a relatively more triangularly prismatic shape as compared to the relatively more rectangularly prismatic shape of the bodies 154, 202, e.g., to at least partially define arms and/or legs. The enclosure 452 is adjustably and suitably sized and/or shaped to be able to enclose the body 454 (e.g., and expose a corresponding body, such as having another human appearance, of the toy FIG. 450).

FIG. 10B illustrates a perspective view of a toy FIG. 500, which includes an enclosure 502 having adjustable segments. The toy FIG. 500 includes a body 504 that is exposed and provides an appearance of an animal and/or animal-like character, such as a cat, dog, or an imaginary creature of similar stature. To this end, the body 504 is differently shaped as compared to the body 454 of the toy FIG. 450 and the bodies 154, 202 of the toy FIG. 150. Moreover, the enclosure 502 may have additional features to enhance the appearance of the toy FIG. 500. For instance, the enclosure 502 may include first features 506 to provide an appearance of ears and a second feature 508 to provide an appearance of a snout. The features 506, 508 help provide the appearance of an animal more realistically or more clearly.

The enclosure 502 is adjustable to form an internal volume that encloses the body 504 in a different configuration. In such a configuration, the features 506, 508 may project inwardly into the internal volume. In some embodiments, to accommodate positioning of the features 506, 508 within the internal volume (e.g., and enable the segments of the enclosure 502 to be arranged to couple to one another), the features 506, 508 may engage the body 504. By way of example, the body 504 may include a recess in which the first features 506 may extend. Additionally or alternatively, the second feature 508 may be positioned against the body 504. Such positioning of the features 506, 508 with respect to body 504 may avoid undesirable contact between the features 506, 508 and the body 504 that would otherwise prevent the enclosure 502 from fully enclosing the body 504. In certain embodiments, the enclosure 502 may include corresponding features (e.g., corresponding features that provide an appearance of an ear and snout) that are visible while the enclosure 502 encloses the body 504 (e.g., while the features 506, 508 are not visible), and the corresponding features may also provide an appearance of an animal. The toy FIG. 500 may also include another body that is visible while the enclosure 502 encloses the body 504, and the other body may further provide an appearance of an animal (or any other character). As such, the toy FIG. 500 may provide an appearance of different animals (e.g., of different species of animals) in the different configurations, transform/morph between an animal appearance and a human-like appearance during a configuration transition, and/or change in any other way.

FIG. 10C illustrates a perspective view of a toy FIG. 550, which includes an enclosure 552 having adjustable segments. The adjustable segments are arranged to expose a body 554 of the toy FIG. 550. The body 554 is differently shaped from the body 504 of the toy FIG. 500, the body 454 of the toy FIG. 450, and the bodies 154, 202 of the toy FIG. 150. For example, the body 554 may provide an appearance of yet another animal, such as of a sheep. The enclosure 552 is adjustable to enclose the body 554. Indeed, it should be noted that a toy figure may have a body of any size or shape, as well as an enclosure having a suitable size and/or shape to be able to enclose such a body.

While the toy figure presented herein has been illustrated and described in detail and with reference to specific embodiments thereof, it is nevertheless not intended to be limited to the details shown, since it will be apparent that various modifications and structural changes may be made therein without departing from the scope of the disclosure and within the scope and range of equivalents of the claims. In addition, various features from one of the embodiments may be incorporated into another of the embodiments. That is, it is believed that the disclosure set forth above encompasses multiple distinct embodiments with independent utility. While each of these embodiments has been disclosed in a preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy playset described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Moreover, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially". For example, the term "approximately" can denote a tolerance of plus or minus 0.002 inches, 0.001 inches, or up to 0.005 inches. The same applies to the terms "about" and "around" and "substantially." Moreover, for the purposes of the present disclosure, the phrase "A and/or B" means (A), (B), or (A and B), and the phrase "A, B, and/or C" means (A), (B), (C), (A and B), (A and C), (B and C), or (A, B and C).

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A toy figure, comprising:

a base;

a body extending from the base; and a plurality of segments, wherein a subset of the plurality of segments is configured to rotate relative to the base to transition the toy figure between a first configuration and a second configuration, the plurality of segments and the base are configured to cooperatively form an enclosure in the first configuration and in the second configuration, the enclosure encloses the body in the first configuration, and the body extends external to the enclosure in the second configuration.

2. The toy figure of claim 1, wherein the subset of the plurality of segments comprises a first segment, the plurality of segments comprises a second segment, and the second segment is coupled to the first segment and is configured to rotate relative to the first segment.

3. The toy figure of claim 2, wherein a surface of the second segment of the plurality of segments faces an internal volume defined by the plurality of segments in the first configuration of the toy figure, and the surface of the second segment faces away from the internal volume defined by the plurality of segments in the second configuration of the toy figure.

4. The toy figure of claim 2, wherein the subset of the plurality of segments comprises a third segment, and the second segment of the plurality of segments is configured to couple to the third segment in each of the first configuration of the toy figure and the second configuration of the toy figure.

5. The toy figure of claim 4, wherein the plurality of segments comprises a fourth segment, the fourth segment is coupled to the second segment of the plurality of segments and is configured to rotate relative to the second segment, and the fourth segment is configured to couple to the third segment of the subset of the plurality of segments in each of the first configuration of the toy figure and the second configuration of the toy figure.

6. The toy figure of claim 5, wherein the first segment of the subset of the plurality of segments, the second segment of the plurality of segments, and the fourth segment of the plurality of segments cooperatively form a U-shaped configuration about the body in the first configuration of the toy figure.

7. The toy figure of claim 5, wherein the subset of the plurality of segments comprises a fifth segment, and the fifth segment is configured to couple to the second segment of the plurality of segments in each of the first configuration of the toy figure and the second configuration of the toy figure.

8. The toy figure of claim 7, wherein each of the third segment and the fifth segment of the subset of the plurality of segments is configured to couple to the first segment of the subset of the plurality of segments, the second segment of the plurality of segments, and the fourth segment of the plurality of segments in each of the first configuration of the toy figure and the second configuration of the toy figure.

9. The toy figure of claim 2, wherein the first segment of the subset of the plurality of segments is configured to extend from the base in a first direction in the first configuration of the toy figure, and the first segment is configured to extend from the base in a second direction, opposite the first direction, in the second configuration of the toy figure.

10. The toy figure of claim 1, wherein the body is a first body extending from a first surface of the base, the toy figure comprises a second body extending from a second surface, opposite the first surface, of the base, and the enclosure encloses the second body in the second configuration of the toy figure.

11. A toy figure, comprising:

a base;

a body extending from the base at a first side; and an enclosure comprising a plurality of segments, wherein a subset of the plurality of segments is configured to rotate relative to the base to transition the toy figure between a first configuration and a second configuration, the enclosure defines an internal volume at the first side of the base in the first configuration of the toy figure such that the body extends into the internal volume in the first configuration, and the enclosure defines the internal volume at a second side, opposite the first side, of the base in the second configuration of the toy figure such that the body is external to the internal volume in the second configuration.

12. The toy figure of claim 11, comprising an additional body extending from the base at the second side such that the additional body is external to the internal volume of the enclosure in the first configuration of the toy figure and extends into the internal volume of the enclosure in the second configuration of the toy figure.

13. The toy figure of claim 12, wherein the subset of the plurality of segments comprises a segment, a first surface of the segment faces the body in the first configuration, and a second surface, opposite the first surface, of the segment faces the additional body in the second configuration of the toy figure.

14. The toy figure of claim 13, wherein the segment of the subset of the plurality of segments is a first segment, the subset of the plurality of segments comprises a second segment, and the first segment and the second segment are configured to couple to one another in each of the first configuration of the toy figure and the second configuration of the toy figure to retain the enclosure in the first configuration or in the second configuration.

15. The toy figure of claim 14, wherein the plurality of segments comprises a third segment coupled to and configured to rotate about the first segment of the subset of the plurality of segments, and the third segment and the second segment are configured to couple to one another in each of the first configuration of the toy figure and the second configuration of the toy figure to retain the enclosure in the first configuration or in the second configuration.

16. A toy figure, comprising:

a first body extending from a first surface of a base of the toy figure;

a second body extending from a second surface, opposite the first surface, of the base of the toy figure; and a plurality of segments, wherein the plurality of segments comprises a first segment coupled to the base and a second segment coupled to the first segment, the first segment is configured to rotate relative to the base and the second segment is configured to rotate relative to the first segment to transition the toy figure between a first configuration and a second configuration, the first segment extends away from the first surface in the first configuration, and the first segment extends away from the second surface in the second configuration.

17. The toy figure of claim 16, wherein a third surface of the second segment faces the second body in the first configuration, and the third surface faces away from the first body in the second configuration.

18. The toy figure of claim 16, wherein the plurality of segments comprises a third segment coupled to the base, the second segment of the plurality of segments comprises a first plurality of extensions, the third segment comprises a second plurality of extensions, and the first plurality of extensions and the second plurality of extensions are configured to interface with one another in each of the first configuration of the toy figure and the second configuration of the toy figure to couple the second segment and the third segment to one another.

19. The toy figure of claim 18, wherein the first plurality of extensions of the second segment comprises a first extension, the second plurality of extensions of the third segment comprises a second extension and a third extension, and the second extension and the third extension are configured to capture the first extension in each of the first configuration of the toy figure and the second configuration of the toy figure to interface the first plurality of extensions and the second plurality of extensions with one another.

20. The toy figure of claim 18, wherein the third segment of the plurality of segments comprises a third plurality of extensions, the first segment of the plurality of segments comprises a fourth plurality of extensions, and the third plurality of extensions and the fourth plurality of extensions are configured to interface with one another in each of the first configuration of the toy figure and the second configuration of the toy figure to couple the first segment and the third segment to one another.

* * * * *